US006243994B1

(12) United States Patent
Bernini

(10) Patent No.: US 6,243,994 B1
(45) Date of Patent: Jun. 12, 2001

(54) JOINT FOR PRE-CAST CONCRETE TWIN-LEAF ARCH SECTIONS

(75) Inventor: Joe Bernini, Binz (CH)

(73) Assignee: Bebo of America, Inc., Montgomery, AL (US)

( * ) Notice: Subject to any disclaimer, the term of this patent is extended or adjusted under 35 U.S.C. 154(b) by 0 days.

(21) Appl. No.: 09/227,826

(22) Filed: Jan. 11, 1999

(51) Int. Cl.[7] ..... E04B 1/32

(52) U.S. Cl. ..... 52/86; 52/89; 52/223.9; 52/724.4; 52/745.08; 405/126; 405/135; 14/26

(58) Field of Search ..... 52/86, 88, 89, 52/223.7, 223.9, 223.11, 583.1, 582.1, 590.1, 605, 607, 724.4, 745.08, 601; 405/126, 134, 135, 146, 153; 14/24–26

(56) References Cited

U.S. PATENT DOCUMENTS

| | | | | |
|---|---|---|---|---|
| 948,500 | | 2/1910 | Davis . | |
| 1,443,292 | | 1/1923 | Sweney . | |
| 1,535,162 | | 4/1925 | Kime . | |
| 1,639,930 | | 8/1927 | Davidson . | |
| 1,654,625 | | 1/1928 | Wilson . | |
| 1,761,306 | | 6/1930 | McKeown . | |
| 1,984,196 | | 12/1934 | Moss . | |
| 2,478,421 | | 8/1949 | Pedersen . | |
| 2,877,506 | * | 3/1959 | Almoslino | 52/601 X |
| 3,473,273 | | 10/1969 | Gunkel . | |
| 3,881,289 | | 5/1975 | Mauroner . | |
| 3,906,687 | | 9/1975 | Schupack . | |
| 4,037,417 | * | 7/1977 | Oger | 52/88 X |
| 4,104,885 | * | 8/1978 | Thomas | 52/89 X |
| 4,464,803 | * | 8/1984 | Bonasso | 52/86 X |
| 4,485,598 | | 12/1984 | Guardiani . | |
| 4,644,710 | | 2/1987 | Lippe . | |
| 4,649,676 | | 3/1987 | Davey . | |
| 4,685,829 | | 8/1987 | Matiere . | |
| 4,745,713 | * | 5/1988 | Gotoh | 52/88 |
| 4,781,006 | * | 11/1988 | Haynes | 62/601 X |
| 4,836,714 | | 6/1989 | Matiere . | |
| 5,113,543 | | 5/1992 | Sevenet . | |
| 5,351,353 | * | 10/1994 | Walters | 52/86 X |
| 6,161,342 | * | 12/2000 | Barbier et al. | 52/86 |

FOREIGN PATENT DOCUMENTS

| | | | | |
|---|---|---|---|---|
| WO92/07144 | * | 4/1992 | (WO) | 52/745.07 |

* cited by examiner

*Primary Examiner*—Carl D. Friedman
*Assistant Examiner*—Winnie Yip
(74) *Attorney, Agent, or Firm*—Terry M Gernstein

(57) ABSTRACT

A joint for pre-cast concrete twin-leaf arch sections is self-aligning when the two arch sections are initially brought into abutting contact with each other. The joint provides a rigid connection between the twin units and is achieved on site by means of re-inforced cast-in-place concrete. Reinforcement splices for the connection are lap splices, and the joint allows pouring the cast-in-place concrete without the need of formwork. For load distributing purposes, a continuous connection of individual arch rings in the longitudinal direction at the arch crown is possible. An initial abutting contact between the twin units is provided by the joint of the present invention. The contact provided by the joint of the present invention is self-aligning, locking, allows the controlled transmission of the abutting force and allows for a temporary connection. The joint includes mechanical elements for aligning and locking the two arch sections together. The mechanical elements include, in the preferred embodiment, a projection on one arch section and a depression on the other arch section. Cast-in-place concrete is placed in boxed-out, or step, sections located adjacent to the mechanical elements and completes the joint.

23 Claims, 6 Drawing Sheets

JOINT FOR PRE-CAST CONCRETE TWIN-LEAF ARCH SECTIONS

TECHNICAL FIELD OF THE INVENTION

The present invention relates to the general art of large pre-cast concrete arch structures, and to the particular field of joints for large pre-cast concrete arch structures.

BACKGROUND OF THE INVENTION

Large span pre-cast concrete arch structures are often used in road building and the like. As used herein, the term "large arch structure" will mean an arch structure large enough for pedestrian or vehicular passageways, parking or large enough to support vehicle traffic over a roadway or a waterway as opposed to conduits and the like which enclose cables or drainage. These large structures need to be built from two or more arch segments due to transporting size and weight restrictions. Such arch segments are connected on site. A structure formed of twin-leaf arch sections is shown in FIG. 3.

Quite often, a rigid connection of precast concrete elements is made from reinforced cast-in-place concrete. The simplest and most commonly used joint for reinforcing steel is a lap splice. The present invention uses reinforced cast-in-place concrete for a joint and lap splices for reinforcement.

There are several methods presently employed to join twin-leaf arch sections together. As shown in FIG. 1, two cranes C1 and C2 are used in one method, and as shown in FIG. 2, one crane C3 and a scaffolding SC can be used.

With regard to FIG. 1, it can be seen that crane C1 will support section S1 of a pre-cast concrete twin-leaf arch structure 10 in place while crane C2 moves section S2 into place adjacent thereto, or vice versa as those skilled in the art will understand. Referring to FIG. 2, it will be seen that a single crane C3 will position section S2 in place with crown area CA2 supported on scaffold SC and then move section S1 into position with its crown area CA1 being placed in abutting contact with crown area CA2 on scaffold SC.

Quite often, the arch spans a body of water or a railway or highway in operation. The use of a central scaffolding is then not possible and two cranes are used for the installation. Using this method, an initial abutting contact is established between the twin units. Preferably, the joint includes mechanical elements for aligning and locking the two arch sections together when brought into abutting contact. Also, the joint should allow a controlled transmission of the abutting force and the use of a (temporary) connection for safety reasons.

For the same reasons that a central scaffolding may not be used, there is also a need that a cast-in-place concrete can be poured without an extra formwork to be installed.

In a prior art method of joining the twin-leaf arch sections, the crown areas are placed in abutting contact and filled in situ with concrete to complete the joint. As shown in FIGS. 4 and 5, the sections have crown areas, such as CA1 shown in FIG. 5 that include a stepped portion CA1S and a shoulder SH1 joining stepped portion CA1S to top surface TS1 of section S1. Section S1 has an end E1 that abuts end E2 of section S2 as indicated in FIG. 4 when the two sections are set up. A joint-forming portion JS is formed by the co-operating stepped sections CA1 and CA2 of sections S1 and S2 respectively, As shown in FIG. 3, portion JS is then filled in with concrete CT to complete the joint.

This method is meant to be used in connection with the erection method shown in FIG. 2, and in a method in which the joint concrete is poured and cured before the scaffolding is removed. If used with the method of FIG. 1, it is time consuming to properly orient the two arch sections with respect to each other. The joint is not locked when in abutting contact, and often, the uncontrolled transmission of the abutting force leads to spalling of the concrete.

Therefore, there is a need for a joint for precast concrete twin-leaf arch sections which is efficiently formed, can be formed over long spans and/or bodies of water or the like, allows a controlled transmission of abutting force and will retain the proper orientation of the two arch sections during the joint forming process.

In the case of a joint for large cast-in-place arches, the inventor has found that the joint needs to fulfill the following requirements:

The joint should be rigid and moment transmitting;

The joint should allow normal lap splices for reinforcement;

The joint should not require a form for pouring the cast-in-place concrete; and

A continuous (load distributing) connection of the individual arch rings in the longitudinal direction at the arch crown should be possible.

Therefore, there is a need for a joint for large cast-in-place concrete arch segments that will fulfil the just-mentioned requirements.

OBJECTS OF THE INVENTION

It is a main object of the present invention to provide a joint for precast concrete twin-leaf arch sections which is efficiently and accurately formed.

It is another object of the present invention to provide a joint for precast concrete twin-leaf arch sections which is efficiently accurately formed and which can be efficiently used over spans which are not suitable for scaffolding.

It is another object of the present invention to provide a joint for precast concrete twin-leaf arch sections which is efficiently and accurately formed and will maintain the desired orientation of one section relative to the other during erection.

It is another object of the present invention to provide a joint for precast concrete twin-leaf arch sections that allows the use of simple lap splices of the joint reinforcement.

It is another object of the present invention to provide a joint for precast concrete twin-leaf arch sections which includes a self-aligning and locking feature that allows a controlled transmission of the abutting force and includes the possibility to temporarily secure the twin-leaf units.

It is another object of the present invention to provide a joint for precast concrete twin-leaf arch sections that allows a continuous connection of the individual arch rings in the longitudinal direction for load distributing purposes.

It is another object of the present invention to provide a joint for precast concrete twin-leaf arch sections which does not require an extra formwork for the cast-in-place joint concrete to be poured.

SUMMARY OF THE INVENTION

These, and other, objects are achieved by a joint for precast concrete twin-leaf arch sections that includes self-aligning elements on each arch section that engage co-operating elements on the other section when the two arch sections are initially brought into abutting contact with each other. The self-aligning elements then co-operate to mechanically lock one arch section to the other and hold the two sections locked during the remainder of the joint formation process. The self-aligning elements co-operate to allow a controllable transmission of the abutting force. It is here noted that the joint of the present invention is described as being "mechanical" in order to distinguish it from other means, such as adhesive or the like for holding two elements together.

Specifically, the mechanical lock embodying the best mode of carrying out the present invention includes a protrusion on the end of one arch section and a depression defined in the end of the other arch section to receive the protrusion when the two arch sections are brought into initial abutting contact with each other.

The joint of the present invention includes means to temporarily secure the twin units until the joint is completed, and further provides sufficient open space to be filled with cast-in-place concrete for accommodating re-bar elements that form simple lap splices. The joint of the present invention also provides means to link two adjacent arch rings together by means of re-bars and concrete or by dowels for longitudinal load distribution. The joint of the present invention further allows the cast-in-place concrete to be poured without the need for extra formwork.

The joint of the present invention further includes areas for accommodating re-bar elements and dowel elements as well as concrete to complete the joint.

The self-aligning feature of the present invention provides a joint for precast concrete twin-leaf arch sections which is efficiently and accurately formed. Once formed, the joint securely maintains the relative orientation between the arch sections. The joint embodying the present invention can be accurately and efficiently formed in situations where scaffolding cannot be used.

BRIEF DESCRIPTION OF THE DRAWING FIGURES

Other objects, features and advantages of the invention will become apparent from a consideration of the following detailed description and the accompanying drawings.

FIG. 1 indicates a prior art method of erecting pre-cast concrete twin-leaf arch sections using two cranes.

FIG. 2 indicates a prior art method of erecting pre-cast concrete twin-leaf arch sections using one crane and scaffolding.

DETAILED DESCRIPTION OF THE PREFERRED EMBODIMENT OF THE INVENTION

Figure 1:
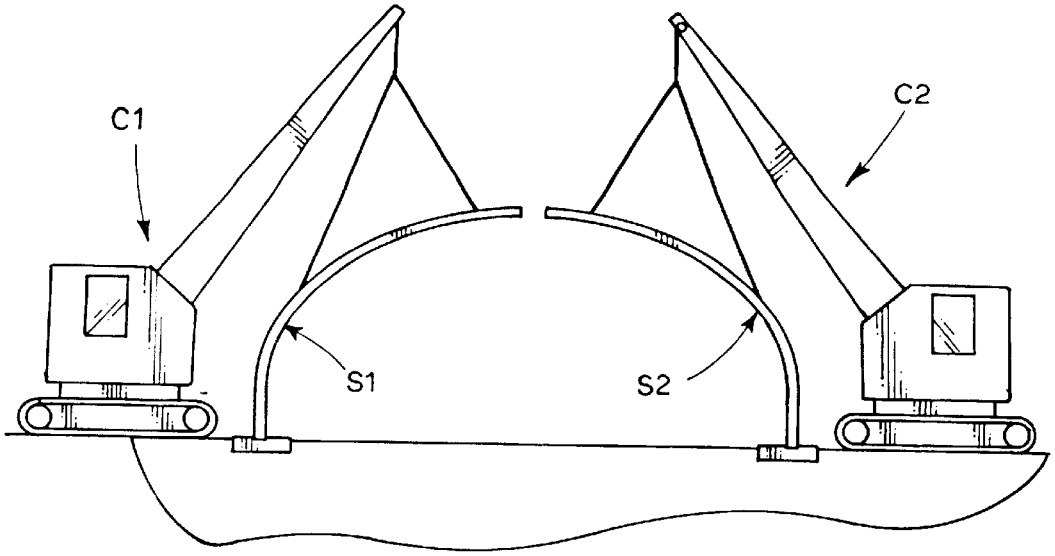
FIG. 1. (PRIOR ART)
Figure 2:
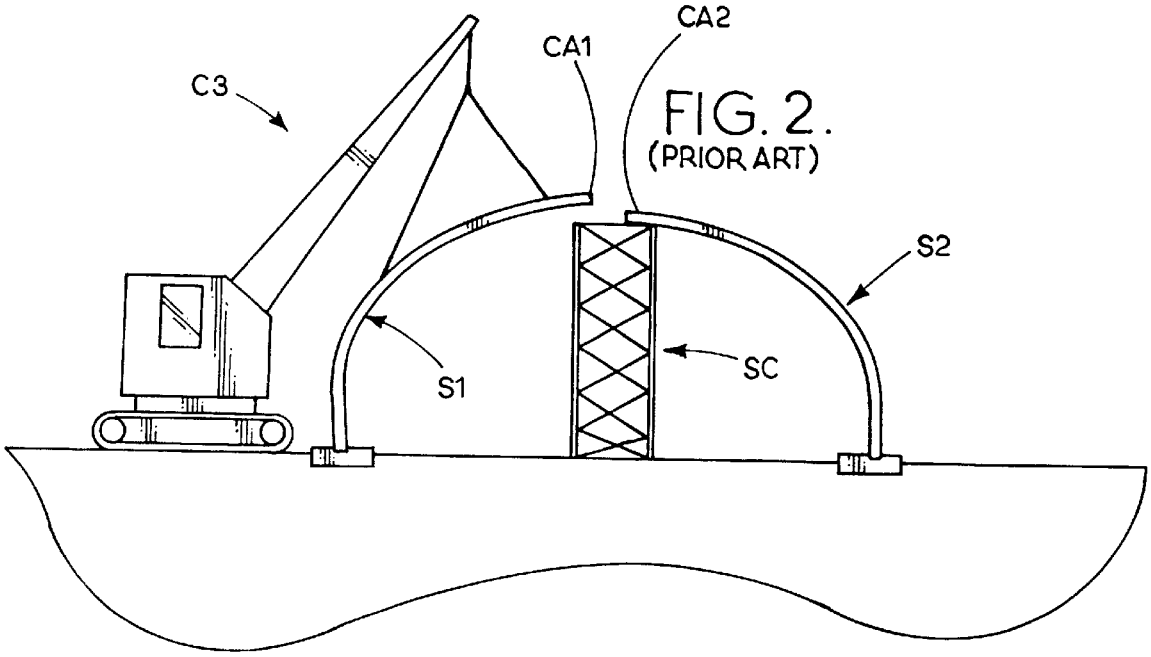
FIG. 2. (PRIOR ART)
Figure 3:
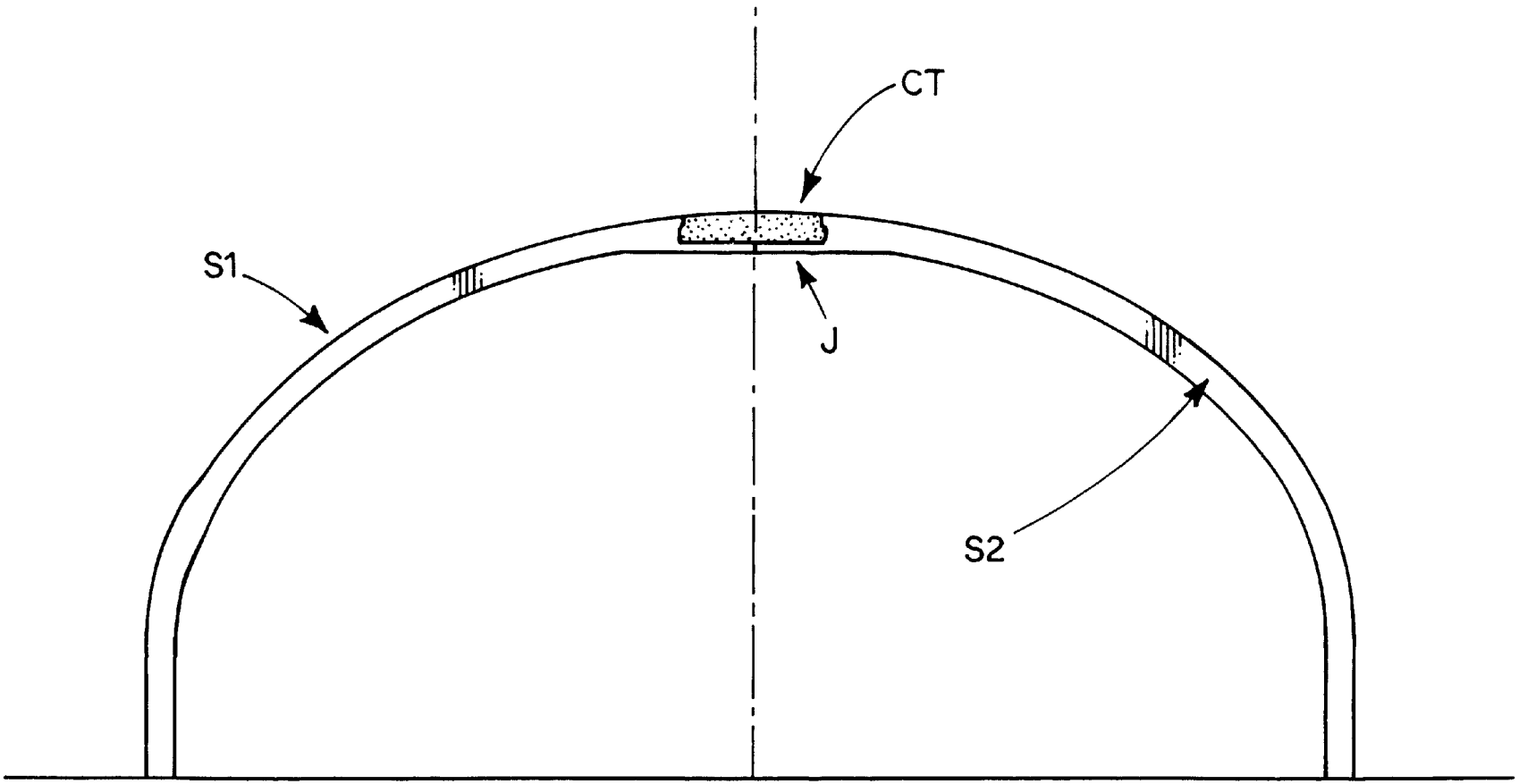
FIG. 3. (PRIOR ART)
FIG. 3 shows an elevational view of a prior art pre-cast concrete twin-leaf arch.
Figure 5:
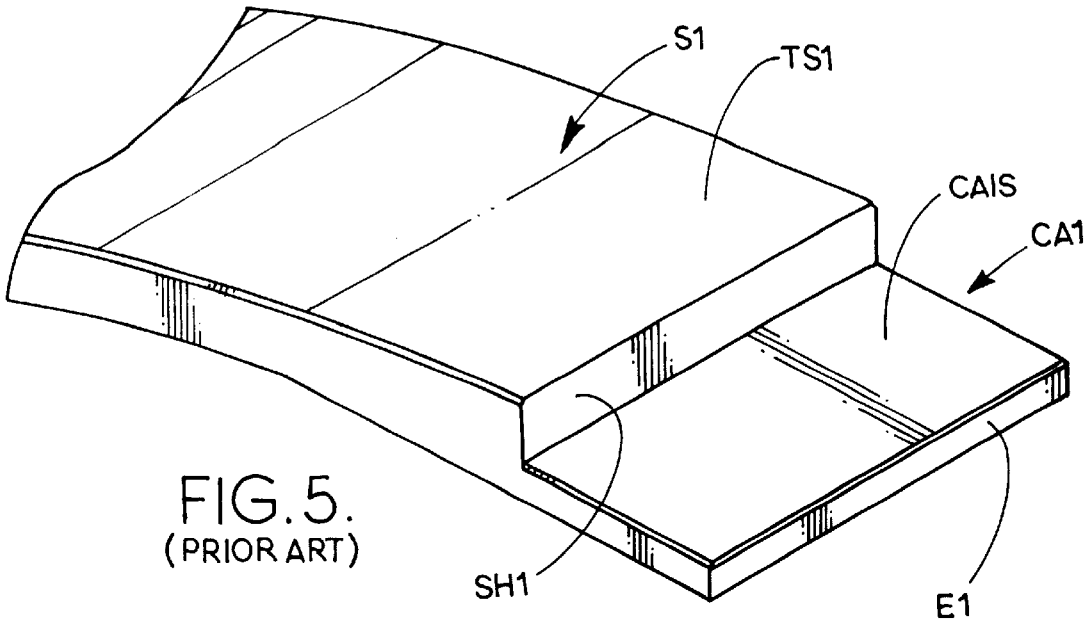
FIG. 5. (PRIOR ART)
FIG. 5 shows one section of joint for pre-cast concrete twin-leaf arch sections.
Figure 4:
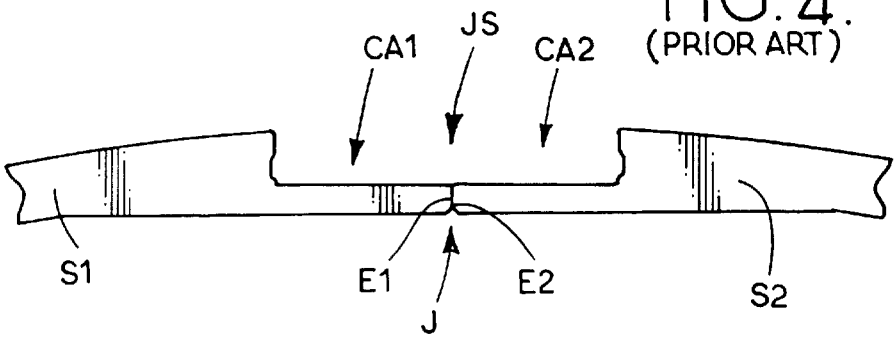
FIG. 4. (PRIOR ART)
FIG. 4 shows a prior art joint for pre-cast concrete twin-leaf arch sections.
Figure 6:
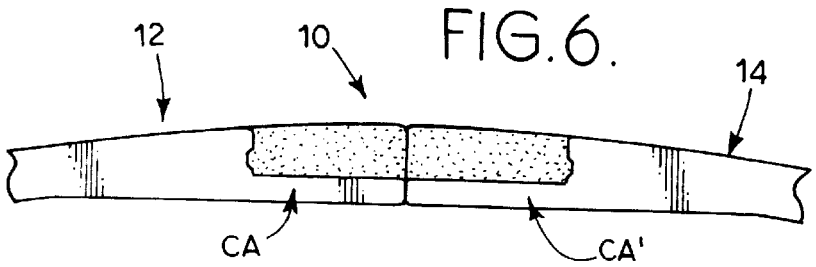
FIG. 6 shows a joint for pre-cast concrete twin-leaf arch sections embodying the present invention.

Shown in FIG. 6 is a joint 10 which mechanically locks one arch section 12 to another arch section 14 of a pre-cast concrete twin-leaf arch. The mechanical lock 10 efficiently and effectively joins section 12 to section 14 at initial abutting contact between the crown areas CA and CA' of these two sections and then maintains that locked connection while the remainder of the joint is formed.

Figure 7A:
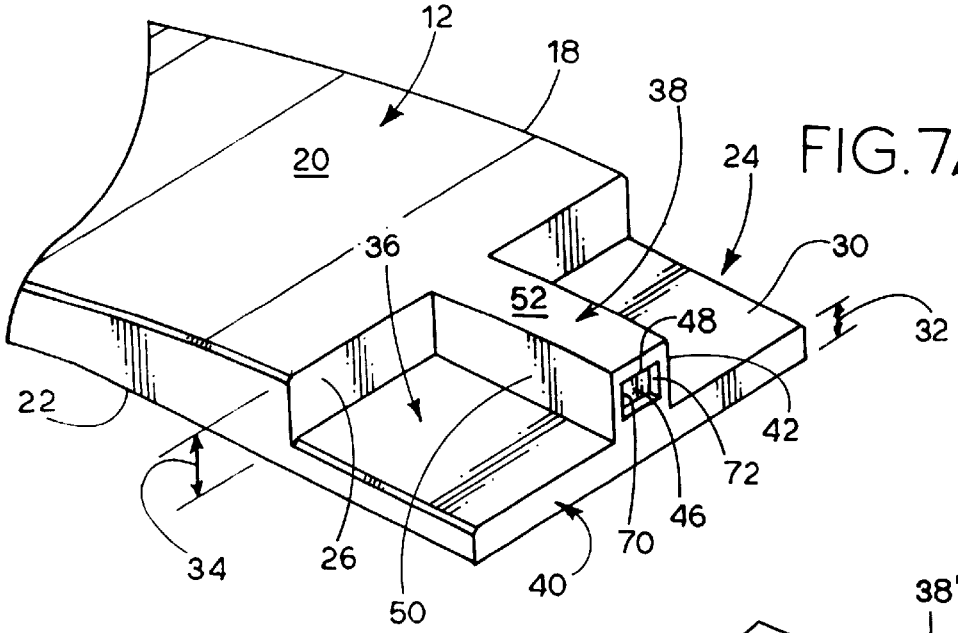
FIG. 7A shows one arch section of the joint with a depression therein.

Arch section 12 is shown in FIG. 7A and includes a main body 18 having a top surface 20 and a bottom surface 22. An end portion 24 includes a shoulder 26 connecting top surface 20 to a joint top surface 30 with thickness 32 between surfaces 22 and 30 being less than thickness 34 between surfaces 20 and 22 whereby a boxed-out portion, or step 36 is defined by surfaces 20 and 22 and shoulder 26. A central portion 38 extends from shoulder 26 to end 40 of arch section 12. A face 42 on portion 38 is co-planar with face 44 of end 40 and has a depression 46 defined therein to extend from face 42 towards shoulder 26 and has a bottom 48 therein. Portion 38 has two sides, such as side 50 that extend from surfaces 30 to a top 52 that is co-planar with top surface 20 to further define steps 36.

Figure 7B:
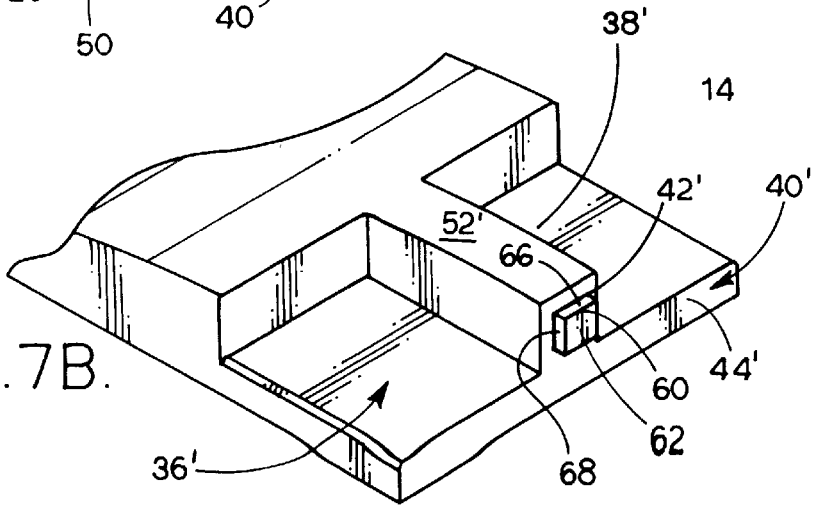
FIG. 7B shows one arch section of the joint with a projection thereon.
Figure 8:
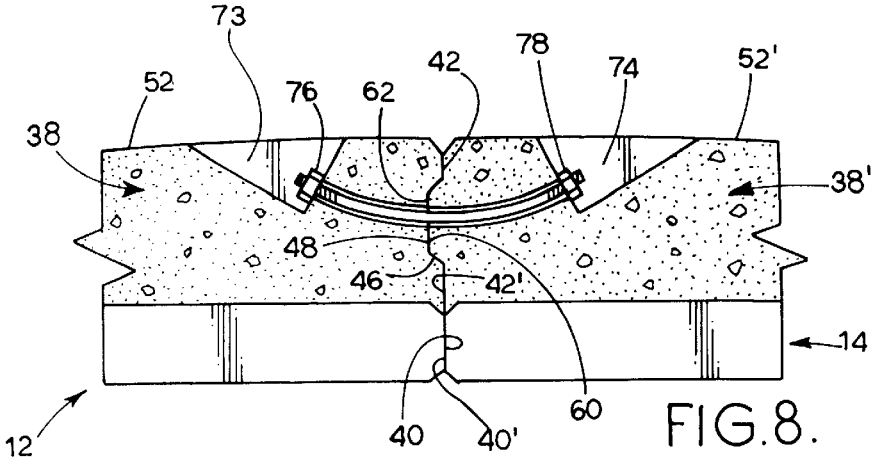
FIG. 8 shows the initial contact area between the two arch sections with a bolt for holding the sections together.

Section 14 is shown in FIG. 7B and is similar to section 12 with the exception of a projection 60 on the end of portion 38'. Projection 60 includes a front end surface 62 which extends beyond face 42' that is co-planar with end 40' of section 14. Projection 60 is dimensioned so end surface 62 abuts bottom 48 of depression 46 and outer surfaces 66 and 68 of projection 60 abuttingly engage walls 70 and 72 of depression 46 when projection 60 is received in depression 46 and ends 40 and 40' are in abutting contact with each other as indicated in FIG. 6. Sections 12 and 14 are aligned, but faces 42 and 42' and 44 and 44' respectively are not in contact to avoid uncontrollable transmission of abutting forces. In this configuration, steps 36 of section 12 are aligned with steps 36' of section 14 and portion 38 of section 12 is aligned with portion 38' of section 14.

As can be understood from the foregoing, when sections 12 and 14 are properly aligned with each other and when section 12 is initially brought into contact with section 14 at bottom 48 and end surface 62, the mechanical coupling will assure such proper relative orientation between sections 12 and 14 and will maintain that orientation as the remainder of joint 10 is formed.

To further ensure that the initial mechanical lock is secure for incidences, a bolt, such as bolt LB, can be placed through portions 38 and 38' and through bottom wall 48 and end 62. Cutout portions 73 and 74 can be defined adjacent to depression 46 and projection 60 respectively to accommodate bolted ends 76 and 78 of bolt LB respectively. Bolt LB can be removed after completion of joint 10 if desired.

Figure 9:
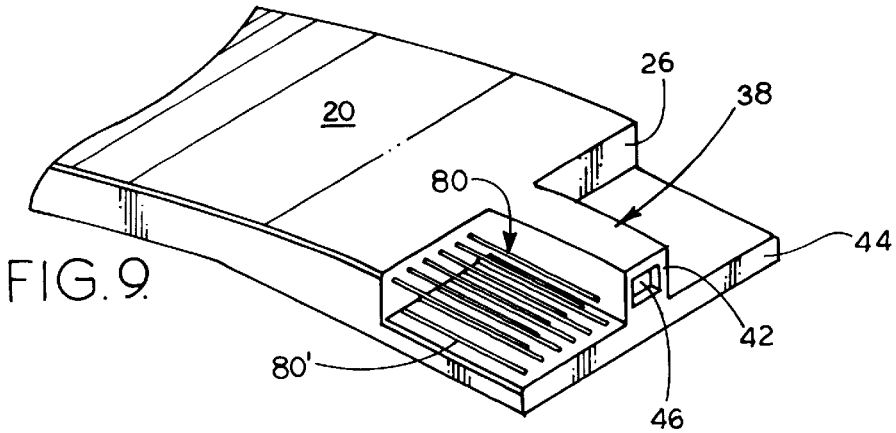
FIG. 9 shows one section of the joint with re-bar elements.
Figure 10:
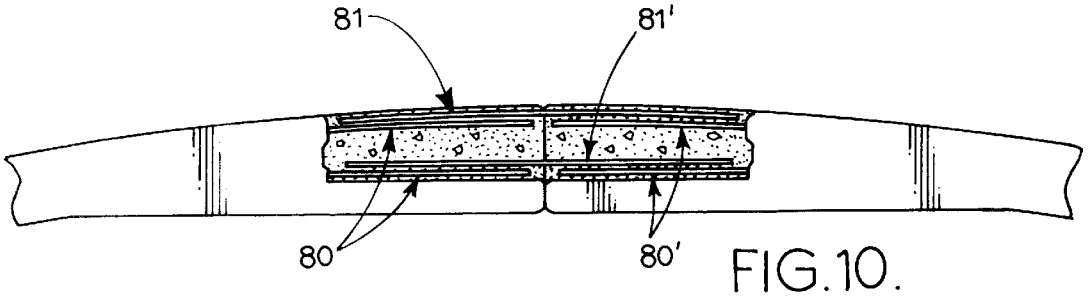
FIG. 10 shows a joint of the present invention with re-bar elements forming lap splices.

As shown in FIGS. 9 and 10, re-bar elements 80 and 80' are mounted on sections 12 and 14 to extend through shoulders 26 and 26' along and beside portions 38 and 38' into steps 36 and 36'. Re-bar elements 81 and 81' are added to form lap splices with the re-bar elements extending from sections 12 and 14.

Figure 11:
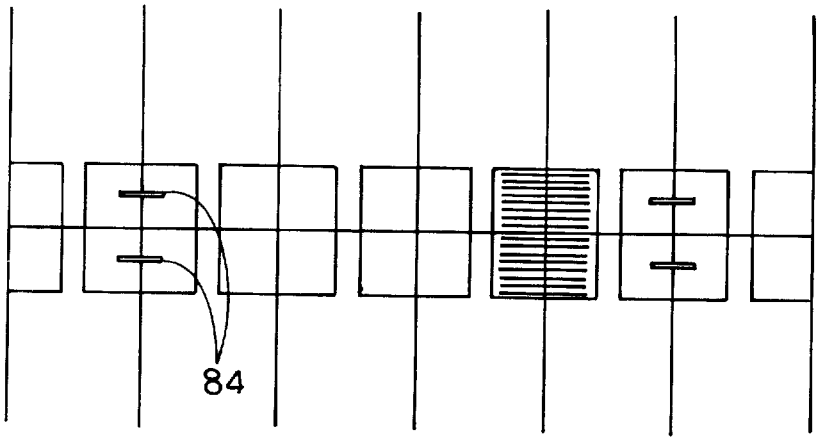
FIG. 11 shows a plurality of arch rings with indications of re-bar elements and dowel elements.
Figure 12:
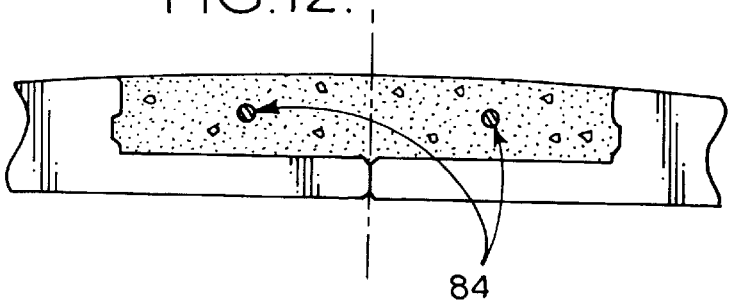
FIG. 12 shows a joint with dowel elements.

Most structures will include a plurality of arch sections. As discussed above, re-bar can be placed longitudinally to reach from steps 36 and 36' of two abutting sections 12 and 14 into the corresponding steps of an adjacent such section pair to create a longitudinal connection between two adjacent section pairs for load distributing purposes. As shown in FIGS. 11 and 12, such load distributing joints in such multiple arch section structures can also be formed by dowel elements. Thus, as shown in FIGS. 11 and 12, dowel elements 84 are included in the joints formed between every fourth arch element. However, as one skilled in the art could understand based on the teaching of this disclosure, more or fewer dowel joints could be included in the overall structure as necessary.

Figure 13:
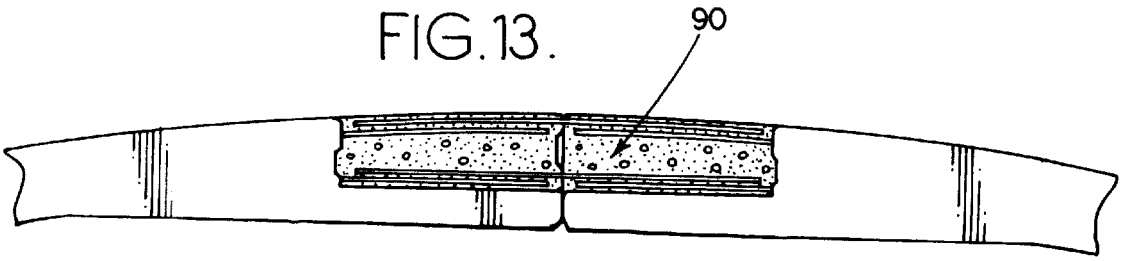
FIG. 13 shows a joint of the present invention with cast-in-place concrete.

The joint is completed by placing cast-in-place concrete 90 in steps 36 and 36' as indicated in FIG. 13. The portions below steps 36 and 36' serve as form for this procedure.

The method of joining two sections of the pre-cast concrete twin-leaf arch sections together will not be presented.

Two sections, such as sections 12 and 14, are located to have ends, such as ends 40 and 40' adjacent to the crown areas of each section in abutting contact with each other. Each end has a mechanical element, such as projection 60 and depression 42, thereon and locks with the element on the other section to prevent movement of one arch section with respect to the other arch section. The joint is completed by adding re-bar elements and locating cast-in-place concrete adjacent to the mechanical lock. A bolt can be placed in the joint adjacent to the mechanical lock to secure the lock. Re-bar or dowel elements can be mounted longitudinally on the joint sections to create a connection between two adjacent arch section pairs for load distributing purposes if desired.

It is understood that while certain forms of the present invention have been illustrated and described herein, it is not to be limited to the specific forms or arrangements of parts described and shown.

What is claimed is:

1. A joint for pre-cast concrete twin-leaf arches for use in road building or the like in which a plurality of twin-leaf arch sections are used to form a large span comprising:

two pre-cast concrete twin-leaf arch sections, each section including a crown area having an end and a central portion, and two side surfaces separated by a longitudinal dimension;

initial contact areas on the ends of said crown areas of said arch sections that allow a controlled transmission of abutting forces;

self-aligning and locking means on the ends of said arch sections for mechanically joining one arch section to the second arch section as said two arch sections are initially brought into contact with each other;

step sections on opposite sides of said central portion of said arch sections for receiving cast-in-plate concrete;

two further pre-cast twin-leaf arch sections, each of which has a crown area and two side surfaces separated by a longitudinal dimension and which are self-aligned and locked by a second self-aligning and locking means and which are positioned longitudinally adjacent to said two pre-cast concrete twin-leaf arch sections locked by said self-aligning and locking means; and arch connecting means in the crown areas of said locked arch sections and said further locked arch sections longitudinally connecting said two locked arch sections to said two further locked arch sections.

2. The joint defined in claim 1 wherein said self-aligning and locking means includes a depression defined on one arch section and a projection on the other arch section.

3. The joint defined in claim 2 wherein said self-aligning and locking means further includes a bolt extending from one arch section to the other arch section and through said projection and said depression.

4. The joint defined in claim 1 said step sections on each arch section adjacent to said self-aligning and locking means.

5. The joint defined in claim 4 further including re-bar elements in said step sections extending from each arch section.

6. The joint defined in claim 5 further including re-bar elements that form lap splices with the re-bar elements extending from each arch section.

7. The joint defined in claim 4 further including cast-in-place concrete in said step sections.

8. The joint defined in claim 2 wherein said depression and said projection are each located in an initial contact area on each arch section.

9. The joint defined in claim 4 wherein said arch connecting means further including re-bar elements located to connect said two arch sections to said two further arch sections.

10. The joint defined in claim 4 wherein said arch connecting means further including dowel elements located to connect said two arch sections to said two further arch sections.

11. The joint defined in claim 4 further including portions in said arch sections that serve as a form for cast-in-place concrete.

12. A method of joining pre-cast concrete twin-leaf arch sections together comprising:

providing pre-cast concrete twin-leaf arch sections each having a central portion and two side surfaces separated by a longitudinal dimension;

abutting a crown section end of arch section against a crown section end of an adjacent arch section;

providing self-aligning and locking means on said crown section ends of said arch sections;

mechanically locking said one arch section to said adjacent arch section during said abutting step;

providing two further pre-cast concrete twin-leaf arch sections each having a central portion and two side surfaces separated by a longitudinal dimension;

mechanically locking said mechanically locked arch sections to the two further locked arch sections located longitudinally adjacent to said mechanical locked arch sections; and placing cast-in-place concrete on the mechanical locked arch sections adjacent to the mechanical lock formed during said mechanical locking step.

13. The method defined in claim 12 wherein the step of mechanically locking one arch section to the other arch section includes providing a projection on one arch section and a depression in the other arch section and placing the projection into the depression.

14. The method defined in claim 13 wherein the step of mechanically locking one arch section to the other arch section includes providing a bolt extending from one arch section to the other arch section through said projection and said depression.

15. The method defined in claim 12 further including a step of defining step sections on each arch section adjacent to the mechanical lock defined in said mechanical locking step.

16. The method defined in claim 12 wherein said step of joining the arch sections together includes placing re-bar elements in said step sections to form lap splices together with re-bar elements extending from the arch sections into the step sections.

17. The method defined in claim 16 further including placing cast-in-place concrete in said step sections.

18. The method defined in claim 12 further including placing re-bar in a longitudinal direction of the twin-leaf arch sections and extending from a step of one twin leaf arch section into a step of the second arch section.

19. The method defined in claim 12 further including placing dowels to extend in a longitudinal direction from the step of the one twin-leaf arch section into the step of the second twin-leaf arch section.

20. A joint for pre-cast concrete twin-leaf arches comprising:

two adjacent pre-cast concrete twin-leaf arch sections, each section including a crown area having an end and a central portion, and two side surfaces separated by a longitudinal dimension;

self-aligning means on the ends of said arch sections for mechanically joining one arch portion adjacent to the crown area of said one arch section to a second arch portion adjacent to the crown area of said second arch section and for automatically orienting each arch section with respect to the other arch section as said arch sections are initially brought into contact with each other adjacent to the crown section of each arch sections;

step sections on opposite sides of said central portions of said arch sections for receiving cast-in-plate concrete;

two further adjacent pre-cast concrete twin-leaf arch sections which include two side surfaces separated by a longitudinal dimension, a crown area, and a further self-aligning means mechanically joining one of said two further adjacent arch sections to the other arch section of said two further adjacent arch sections, said two further adjacent pre-cast concrete twin-leaf arch sections being longitudinal to said two adjacent pre-cast concrete twin-leaf arch sections; and connecting means in the crown areas of said pre-cast twin-leaf arch sections connecting said two adjacent pre-cast concrete twin-leaf arch sections to said two further adjacent pre-cast concrete twin-leaf arch sections.

21. A joint for pre-cast concrete twin-leaf arches comprising:

two adjacent pre-cast concrete twin-leaf arch sections, each section including a crown area having a top surface, a bottom surface and two side surfaces;

initial contact areas in the crown area on said arch sections that allow a controlled transmission of abutting forces; and self-aligning and locking means located substantially centrally between two side surfaces in the crown area on said arch sections for mechanically joining one arch section to the second arch section as said arch sections are initially brought into contact with each other and located spaced from said surfaces, and step sections on each arch section adjacent to said self-aligning and locking means.

22. The joint defined in claim 21 wherein each step section is located between said locking means and one of said two side surfaces.

23. A joint for pre-cast concrete twin-leaf arches comprising:

two adjacent pre-cast concrete twin-leaf arch sections, each section including a crown area, a top surface, a bottom surface and two side surfaces; and self-aligning means in the crown area on said arch sections spaced from said side surfaces for mechanically joining one arch portion adjacent to the crown area of said one arch section to the second arch portion adjacent to the crown area of said second arch section and for automatically orienting each arch section with respect to the other arch section as said arch sections are initially brought into contact with each other adjacent to the crown section of each arch section and including step sections on each side of said self-aligning means, each step section being located between said self-aligning means and one of said side surfaces of each arch section.

* * * * *